US007493070B2

(12) United States Patent
Lee

(10) Patent No.: US 7,493,070 B2
(45) Date of Patent: Feb. 17, 2009

(54) DEVELOPER AND COLOR IMAGE FORMING APPARATUS USING THE SAME

(75) Inventor: Won-Wook Lee, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 253 days.

(21) Appl. No.: 11/431,047

(22) Filed: May 10, 2006

(65) Prior Publication Data

US 2006/0280527 A1 Dec. 14, 2006

(30) Foreign Application Priority Data

Jun. 10, 2005 (KR) ..... 10-2005-0049700

(51) Int. Cl.
*G03G 15/08* (2006.01)

(52) U.S. Cl. ..... 399/258; 399/262

(58) Field of Classification Search ..... 399/107, 399/111, 119, 120, 252, 258, 262
See application file for complete search history.

(56) References Cited

U.S. PATENT DOCUMENTS 7,228,089 B2 * 6/2007 Saito et al. ..... 399/107
7,289,741 B2 * 10/2007 Kikuchi ..... 399/12

FOREIGN PATENT DOCUMENTS

| | | |
|---|---|---|
| JP | 09-127777 | 5/1997 |
| JP | 2004-170747 | 6/2004 |
| JP | 2004-258472 | 9/2004 |
| JP | 2004-334053 | 11/2004 |

* cited by examiner

*Primary Examiner*—Hoan H Tran
(74) *Attorney, Agent, or Firm*—Roylance, Abrams, Berdo & Goodman, L.L.P.

(57) ABSTRACT

A developer and a color image forming apparatus are provided. The color image forming apparatus includes a development cartridge including a photosensitive drum and a container which stores toner. A toner cartridge is configured to attach to and detach from the development cartridge which contains the toner. A toner transfer unit rotates to agitate the toner stored in the development cartridge so as to move the toner when the toner cartridge attaches to and detaches from the development cartridge.

12 Claims, 5 Drawing Sheets

DEVELOPER AND COLOR IMAGE FORMING APPARATUS USING THE SAME

CROSS-REFERENCE TO RELATED PATENT APPLICATION

This application claims the benefit under 35 U.S.C. § 119 (a) of Korean Patent Application No. 10-2005-0049700, filed on Jun. 10, 2005, in the Korean Intellectual Property Office, the entire disclosure of which is hereby incorporated by reference.

BACKGROUND OF THE INVENTION

1. Field of the Invention

The present invention relates to a developer and an image forming apparatus using the same. More particularly, the present invention relates to a developer including a toner transfer unit to prevent a toner from leaking when a toner cartridge is attached to and detached from a development cartridge and a color image forming apparatus using the developer.

2. Description of the Related Art

Generally, in image forming apparatuses, a digital image signal corresponding to a desired image is received to form an electrostatic latent image onto a photosensitive medium using an exposure unit such as a laser scanning unit (LSU). Then, the electrostatic latent image is developed into a toner image by using a toner. The toner image is transferred onto a recording medium and the toner image is fused and fixed to the recording medium by applying heat and pressure to the toner image. Consequently, a desired image is formed on the recording medium.

According to the type of toners and carriers used therein, the image forming apparatuses can be classified into dry types and wet types. The dry type image forming apparatuses can be classified into an image forming apparatus including a one-component developer and an image forming apparatus including a two-component developer. The one-component developer forms an image by using only toners. The two-component developer forms an image by using toners and carriers. The toner particles are attached to the carriers.

A single pass type color image forming apparatus generally includes four photosensitive drums, four exposure units for forming electrostatic latent images onto the four photosensitive drums, and four developers for developing the electrostatic latent images formed on the four photosensitive drums by supplying toners of black K, cyan C, magenta M, and yellow Y to the electrostatic latent images, respectively. The four photosensitive drums come into contact with an intermediate transfer belt. Toner images of black K, cyan C, magenta M, and yellow Y are developed on the four photosensitive drums and are superpositionally transferred onto the intermediate transfer belt to form a color toner image. The color toner image is transferred and fixed to a sheet of paper to form a color image.

A built-in type developer includes a container for storing a toner so that the developer refilled with the toner can be used. Alternatively, the developer can be replaced with a split-type developer in which a toner can be supplied from a toner cartridge which is detachable from a development cartridge.

In the built-in type, in order to refill the developer with the toner when the toner is used up, the developer is detached from a main frame. The toner is refilled in the developer and then the developer is attached to the main frame again.

Accordingly, there is a relatively small possibility that the toner filled in the developer leaks, which leads to contamination of peripheral devices.

In the split type, in order to refill the developer with the toner again, the toner cartridge for storing the toner is detached from the development cartridge and a new toner cartridge is refilled with toner and attached to the development cartridge. Accordingly, in the way of detaching the toner cartridge from the development cartridge or attaching the new toner cartridge to the development cartridge, the toner remaining in the toner cartridge may leak or a part of the toner filled in the development cartridge may leak out of the development cartridge. This may lead to contamination of the peripheral devices.

Accordingly, there is a need for an improved image forming apparatus to prevent toner from leaking by flattening the toner contained in a development cartridge when a toner cartridge is attached to and detached from the development cartridge.

SUMMARY OF THE INVENTION

An aspect of the present invention is to address at least the above problems and/or disadvantages and to provide at least the advantages described below. Accordingly, an aspect of the present invention is to provide a developer including a toner transfer unit which can prevent toner from leaking by flattening the toner contained in development cartridge when a toner cartridge is attached to and detached from the development cartridge and a color image forming apparatus having the developer.

According to an aspect of the present invention, there is provided a developer comprising a development cartridge including a photosensitive drum and a container which stores toner. A toner cartridge is fitted to and detached from the development cartridge and contains the toner. A toner transfer unit can rotate to vibrate the toner stored in the development cartridge so as to flatten the toner when the toner cartridge is fitted to and detached from the development cartridge.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications to the embodiments described herein can be made without departing from the scope and spirit of the present invention. Also, descriptions of well-known functions and constructions are omitted for clarity and conciseness.

Figure 1:
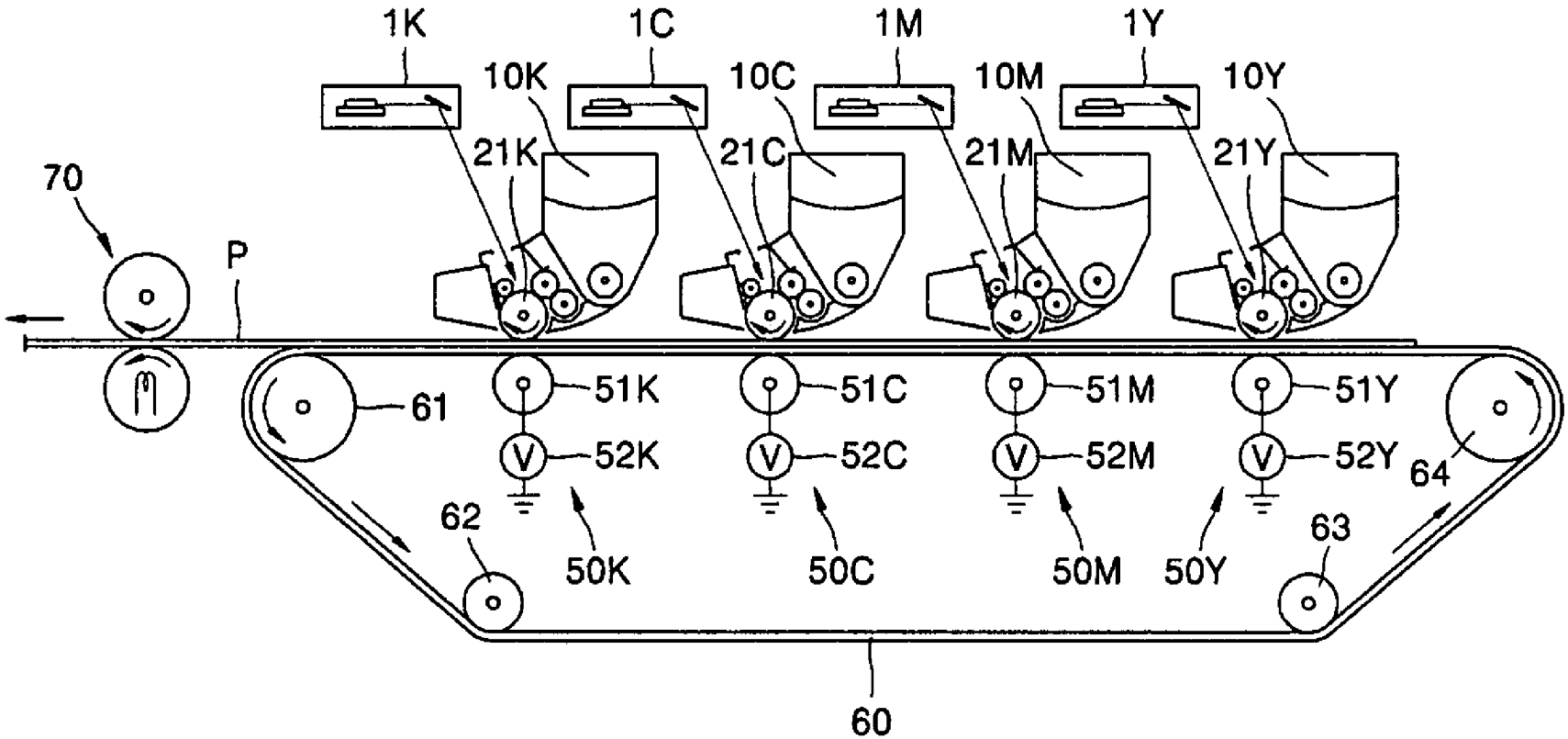
FIG. 1 is a view illustrating a structure of an embodiment of a single pass type color image forming apparatus according to an exemplary embodiment of the present invention.
Figure 2:
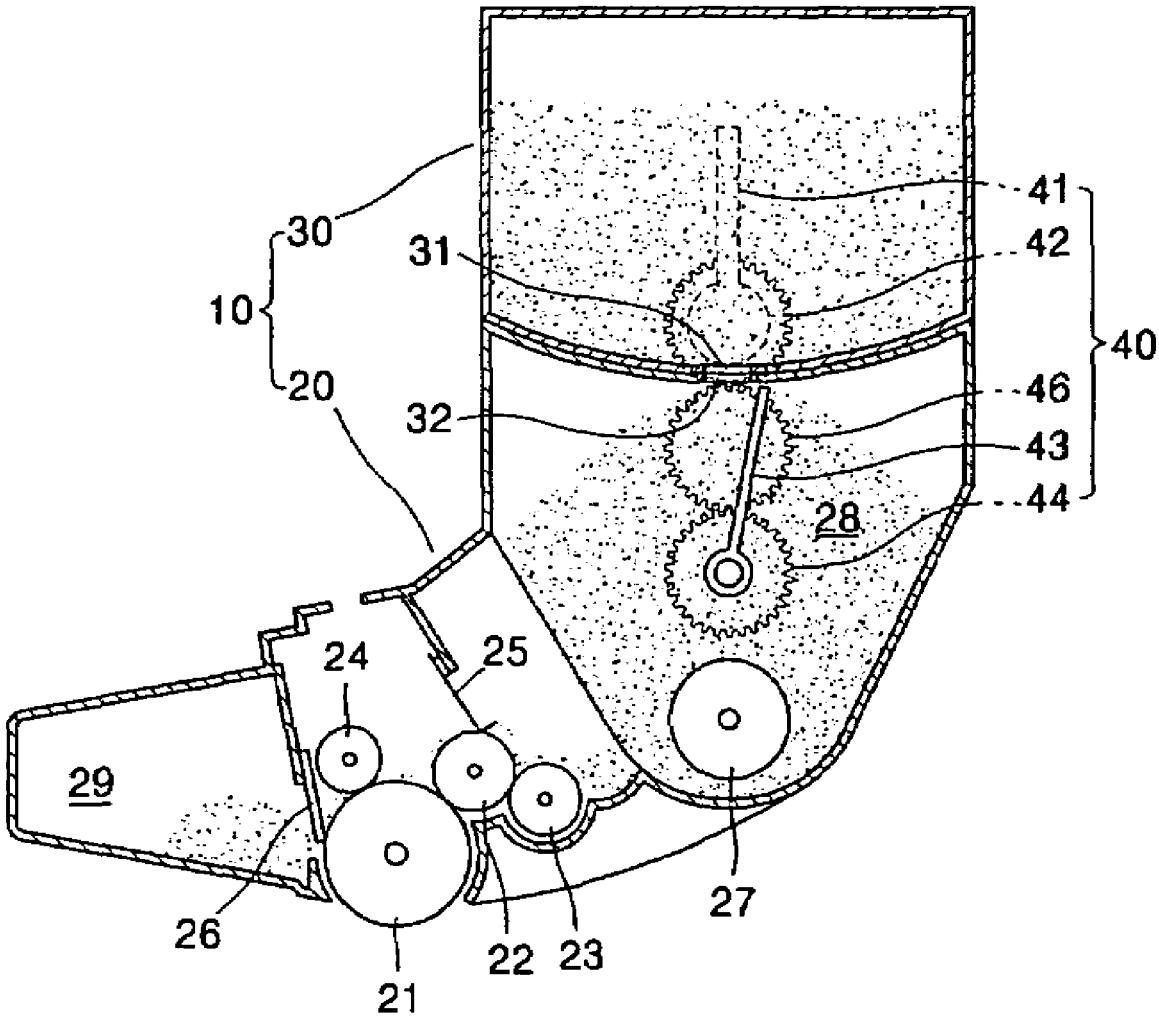
FIG. 2 is a cross-sectional view illustrating a structure of a developer employing a toner transfer unit according to an exemplary embodiment of the present invention.

Referring to FIGS. 1 and 2, a color image forming apparatus includes four exposure units 1K, 1C, 1M, and 1Y, four development units 30K, 30C, 30M, and 30Y having photosensitive drums 21K, 21C, 21M, and 21Y, respectively. The image forming apparatus also includes four transfer members 50K, 50C, 50M, and 50Y, a transfer belt 60, and a fixing device 70.

The exposure units 1K, 1C, 1M, and 1Y form an electrostatic latent image by irradiating light corresponding to image data of black K, cyan C, magenta M, and yellow Y onto the photosensitive drums 21, respectively.

The development units 30K, 30C, 30M, and 30Y, which develop the electrostatic latent images on the photosensitive drums 21 by using toners of black K, cyan C, magenta M, and yellow Y, respectively, include a development cartridge 20, a toner cartridge 30 containing toners that are detachably disposed in the development cartridge 20, and a toner transfer unit 40.

The development cartridge 20 includes a development roller 22, a supply roller 23, a charging roller 24, a metering blade 25, a cleaning blade 26, and a stirring roller 27.

The development roller 22 develops the electrostatic latent image into a toner image on the photosensitive drum 21 using the toners. The supply roller 23 supplies the toners onto the development roller 22.

The charging roller 24 charges the outer circumferential surface of the photosensitive drum 21 to a predetermined electric potential. The metering blade 25 controls the thickness of the toner attached to the outer circumferential surface of the development roller 22 to a predetermined thickness.

The cleaning blade 26 removes toners remained on the surface of the photosensitive drum 21. Waste toners removed by the cleaning blade 26 are stored in a waste toner storage unit 29.

The stirring roller 27 disposed in a container 28 rotates so that the toner stored in the container 28 vibrates in order to prevent the toner from becoming hardened.

Figure 3:
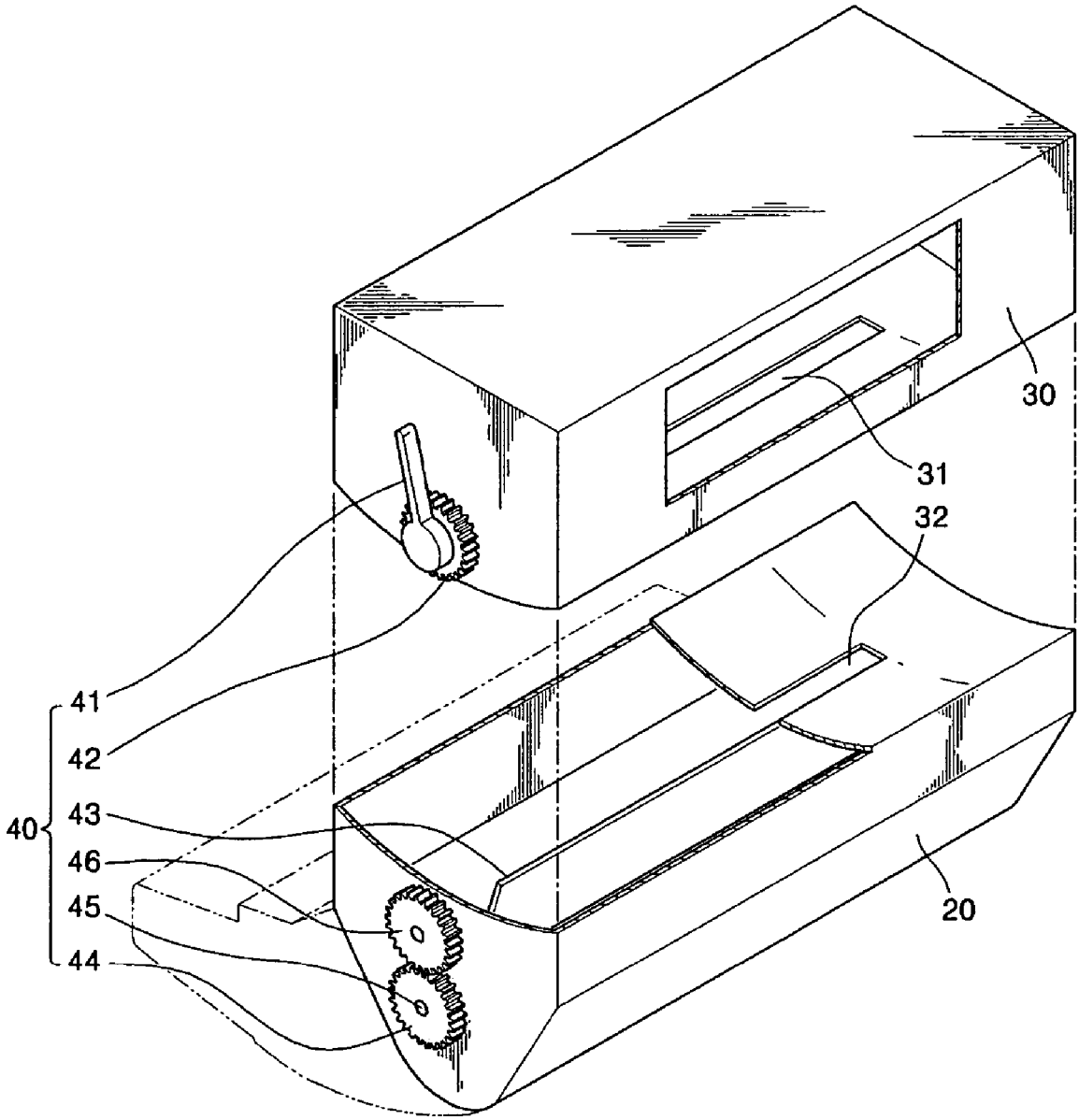
FIG. 3 is a perspective view illustrating a toner cartridge which detaches from a development cartridge in the developer shown in FIG. 2.
Figure 4:
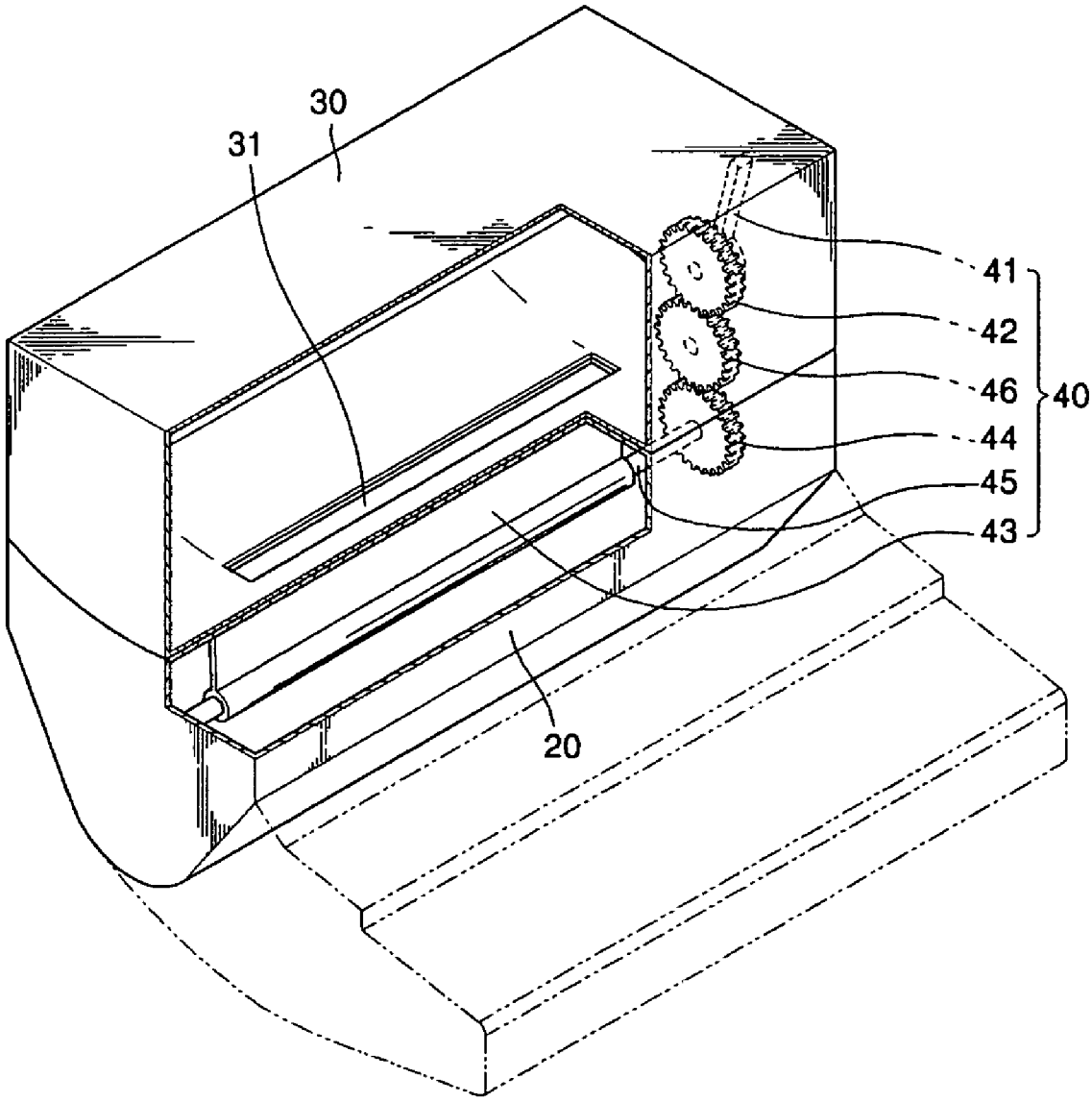
FIG. 4 is a perspective view illustrating the toner cartridge which attaches to the development cartridge in the developer shown in FIG. 2.

The toner cartridge 30, as shown FIGS. 3 and 4, is disposed on the development cartridge 20 in a detachable manner and contains the toner.

At the lower part of the toner cartridge 30, an outflow aperture 31 is formed so that the toner flows out therethrough. Moreover, at the upper part of the development cartridge 20, an inflow aperture 32 corresponding to the outflow aperture 31 is formed so that the toner flows in therethrough. Thus, when the toner cartridge 30 is placed into the development cartridge 20, the outflow aperture 31 and the inflow aperture 32 are connected to each other, so that the toner flows into the development cartridge 20. When the toner cartridge 30 separates from the development cartridge 20, the inflow aperture 32 is exposed to the outside as shown in the FIG. 3.

Meanwhile, the outflow aperture 31 is open and closed by a shutter (not shown in the drawings). When the toner cartridge 30 is placed into the development cartridge 20, the shutter opens the outflow aperture 31 to connect to the inflow aperture 32. When the toner cartridge 30 separates from the development cartridge 20, the shutter closes the outflow aperture 31.

The toner contained in the container 28 is transferred from the toner cartridge 30. As shown in FIG. 2, the toner is loaded mainly on the underneath of the inflow aperture 32. In some cases, if the toner is loaded to come in contact with the inflow aperture 32, when the toner cartridge 30 separates, the toner may leak out of the inflow aperture 32. Alternatively, when the shutter is open and closed, the toner may leak out of the inflow aperture 32.

The toner transfer unit 40, which flattens the toner loaded in the container 28 to prevent the toner from leaking out of an apparatus when the toner cartridge 30 is detached from the development cartridge 20 includes a rotation lever 41 and a toner transfer plate 43.

The rotation lever 41 protrudes from one side of the toner cartridge 30 and is rotatably disposed so as to open and close the shutter (not shown). Although the shutter is not shown in the drawings, the rotation lever 41 and the shutter may be operatively connected by conventional techniques. Thus explanation thereof will be omitted for clarity and conciseness. The rotation lever 41 includes a driving gear 42. The driving gear 42 rotates when the rotation lever 41 rotates, thereby agitating and flattening the toner piled within container 28.

The toner transfer plate 43 is rotatably and longitudinally disposed in the container 28. At an axis 45 of the toner transfer plate 43, a driven gear 44 is provided, which protrudes from one side of the development cartridge 20.

At one side of the development cartridge 20, a transmission gear 46 engages the driven gear 44 and is provided in a rotatable manner. The transmission gear 46 engages the driving gear 42 when the toner cartridge 30 is placed into the development cartridge 20, while separated from the driving gear 42 when the toner cartridge 30 is separated from the development cartridge 20.

Figure 5:
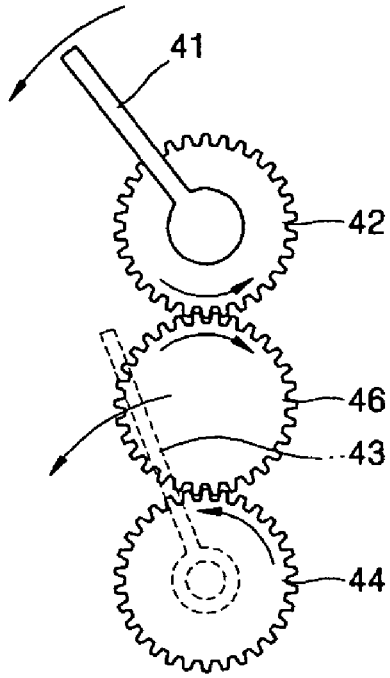
FIGS. 5 and 6 are views illustrating a power transmission path for operations of the toner transfer unit according to an exemplary embodiment of the present invention.
Figure 6:
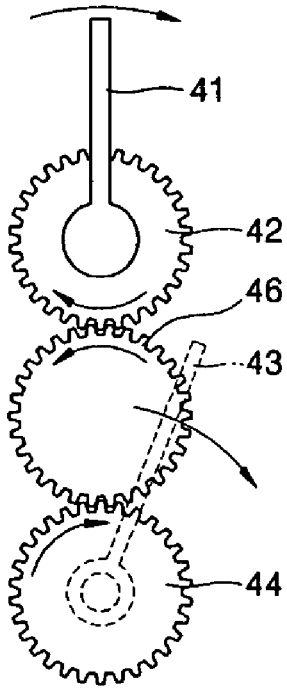

The toner transfer plate 43, as shown in FIG. 5, rotates counterclockwise when the rotation lever 41 engages thereto and rotates counterclockwise. On the other hand, as shown in FIG. 6, the toner transfer plate 43 rotates clockwise when the rotation lever 41 engages thereto and rotates clockwise. Thus, the toner transfer plate 43 rotates by a predetermined angle corresponding to a rotation of the rotation lever 41, so that the driving gear 42, the transmission gear 46, and the driven gear 44 can form teeth only in the portions corresponding to the angles that can be geared with each other.

The rotation lever 41 rotates when the toner cartridge 30 is attached into the development cartridge 20 or separates from the development cartridge 20, and moves the shutter (not shown) so as to close the outflow aperture 31.

The transfer belt 60 facing the photosensitive drums 21K, 21C, 21M, and 21Y transfer a sheet of paper P. The photosensitive drums 21K, 21C, 21M, and 21Y come in contact with the paper P or the transfer belt 60. The paper P is attached to the transfer belt 60 by the electrostatic force.

Transfer members 50K, 50C, 50M, and 50Y include transfer rollers 51K, 51C, 51M, and 51Y facing the photosensitive drums 21K, 21C, 21M, and 21Y and voltage application units 52K, 52C, 52M, and 52Y for applying voltages to the transfer rollers 51K, 51C, 51M, and 51Y.

In the voltage application units 52K, 52C, 52M, and 52Y, if a transfer voltage having an opposite polarity of a toner image is applied to the transfer rollers 51K, 51C, 51M, and 51Y, a transfer electric field is applied to the rear side of the transfer belts 60. The toner image of black K, cyan C, magenta M, and yellow Y formed on the photosensitive drums 21K, 21C, 21M, and 21Y overlaps and is transferred to the paper P. Thus, a color toner image is formed on the paper P. The fixing device 70 fuses the color toner image onto the paper P by applying heat and pressure.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. A developer comprising:

a development cartridge including a photosensitive drum and a container which stores toner;

a toner cartridge configured to attach and detach from the development cartridge which contains the toner; and a toner transfer unit which agitates the toner stored in the development cartridge so as to flatten the toner when the toner cartridge attaches to and detaches from the development cartridge, the toner transfer unit comprising:

a rotation lever which is disposed outside the toner cartridge; and a toner transfer plate which is disposed in the development cartridge to agitate the toner stored in the development cartridge.

2. The developer according to claim 1, wherein the toner transfer unit further comprises:

a transmission gear;

wherein the rotation lever includes a driving gear;

wherein the toner transfer plate includes a driven gear; and wherein the transmission gear connects the driving gear to the driven gear so as to transmit a rotational force, and wherein the toner transfer plate rotates by the rotational force transmitted when the rotation lever rotates.

3. The developer according to claim 2, wherein the transmission gear is provided in the development cartridge.

4. The developer according to claim 2, wherein the toner transfer plate rotates by a predetermined angle only when the rotation lever rotates.

5. The developer according to claim 2, wherein the toner transfer plate is provided in the container.

6. The developer according to claim 1, wherein the toner transfer unit rotates to agitate the toner stored in the development cartridge so as to flatten the toner when the toner cartridge attaches to and detaches from the development cartridge.

7. A color image forming apparatus, comprising:

a plurality of developers on which toner images of different colors are formed, respectively;

a transfer belt which circulates while facing the plurality of developers and which supports a sheet of paper on which the toner images of different colors are transferred; and a plurality of transfer members which face the plurality of developers and which provide an electric field to the rear side of the transfer belt, wherein each developer further comprises:

a development cartridge including a photosensitive drum and a container which stores toner;

a toner cartridge configured to and detach from the development cartridge and which contains the toner; and a toner transfer unit which agitates the toner stored in the development cartridge so as to flatten the toner when the toner cartridge attaches to and detaches from the development cartridge, the toner transfer unit comprising:

a rotation lever which is disposed outside the toner cartridge; and a toner transfer plate which is disposed in the development cartridge to agitate the toner stored in the development cartridge.

8. The color image forming apparatus according to claim 7, wherein the toner transfer unit further comprises:

a transmission gear;

wherein the rotation lever includes a driving gear;

wherein the toner transfer plate includes a driven gear; and wherein the transmission gear connects the driving gear to the driven gear so as to transmit a rotational force, wherein the toner transfer plate rotates by the rotational force transmitted when the rotation lever rotates.

9. The color image forming apparatus according to claim 8, wherein the transmission gear is provided in the development cartridge.

10. The color image forming apparatus according to claim 8, wherein the toner transfer plate rotates by a predetermined angle only when the rotation lever rotates.

11. The color image forming apparatus according to claim 8, wherein the toner transfer plate is provided in the container.

12. The color image forming apparatus of claim 7, wherein the toner transfer unit rotates to agitate the toner stored in the development cartridge so as to flatten the toner when the toner cartridge attaches to and detaches from the development cartridge.

* * * * *